US007789735B2

(12) United States Patent
Weiland

(10) Patent No.: US 7,789,735 B2
(45) Date of Patent: Sep. 7, 2010

(54) DEVICE FOR MACHINING A STRIP OR PLATE-SHAPED METAL WORKPIECE

(75) Inventor: Josef Weiland, Bad Wurzach (DE)

(73) Assignee: Lissmac Maschinenbau und Diamantwerkzeuge GmbH, Bad Wurzach (DE)

( * ) Notice: Subject to any disclaimer, the term of this patent is extended or adjusted under 35 U.S.C. 154(b) by 0 days.

(21) Appl. No.: 11/989,442

(22) PCT Filed: Jul. 24, 2006

(86) PCT No.: PCT/EP2006/007252

§ 371 (c)(1),
(2), (4) Date: Mar. 25, 2008

(87) PCT Pub. No.: WO2007/012438

PCT Pub. Date: Feb. 1, 2007

(65) Prior Publication Data

US 2009/0104859 A1 Apr. 23, 2009

(30) Foreign Application Priority Data

Jul. 25, 2005 (DE) ..... 20 2005 011 640 U

(51) Int. Cl.
*B24B 7/00* (2006.01)

(52) U.S. Cl. ..... 451/182; 451/298; 451/299; 15/88.2

(58) Field of Classification Search ..... 451/182, 451/184, 190, 298, 299, 302, 167, 271, 463, 451/466, 130, 153; 15/88.2, 77, 80, 22.3
See application file for complete search history.

(56) References Cited

U.S. PATENT DOCUMENTS

| | | | | | |
|---|---|---|---|---|---|
| 971,158 | A * | 9/1910 | Soos | 15/78 |
| 1,776,784 | A * | 9/1930 | Cramer | 15/3.16 |
| 2,207,330 | A * | 7/1940 | Osburn | 15/21.1 |
| 2,236,817 | A * | 4/1941 | Evans | 15/80 |
| 2,989,764 | A * | 6/1961 | Peterson | 15/77 |
| 3,410,032 | A * | 11/1968 | Meinerding | 451/296 |
| 3,699,727 | A * | 10/1972 | McDonald | 451/466 |
| 5,360,084 | A * | 11/1994 | Graf | 184/3.2 |
| 5,943,725 | A * | 8/1999 | Wandres | 15/77 |
| 2005/0272353 | A1 * | 12/2005 | Weiland | 451/59 |

FOREIGN PATENT DOCUMENTS

| | | |
|---|---|---|
| DE | 197 39 895 C2 | 3/1999 |
| DE | 103 20 295 A1 | 5/2004 |
| EP | 1 215 010 A2 | 6/2002 |

* cited by examiner

*Primary Examiner*—Maurina Rachuba
(74) *Attorney, Agent, or Firm*—Wells St. John P.S.

(57) ABSTRACT

The invention relates to a device for machining a strip or plate-shaped metal workpiece, which comprises at least one conveying device which is provided with machining elements. The conveying device guides the machining elements at an angle and/or in a transversal manner in relation to the direction of advancement of the workpiece in the region of the workpiece which is to be machined in an at least approximately linear manner. The machining elements are embodied as abrasive paper and support elements are arranged between said abrasive paper.

35 Claims, 4 Drawing Sheets

DEVICE FOR MACHINING A STRIP OR PLATE-SHAPED METAL WORKPIECE

CROSS REFERENCE TO RELATED APPLICATION

This is a 35 U.S.C. §371 application of and claims priority to PCT International Application No. PCT/EP2006/007252, which was filed Jul. 24, 2006, and which claims priority to German Patent Application No. 20 2005 011 640.8, which was filed Jul. 24, 2005, and the teachings of all the applications are incorporated herein by reference.

The invention relates to a device for machining a strip or plate-shaped metal workpiece, comprising at least one revolving conveyor provided with machining elements, the conveyor conveying the machining elements at least approximately in a straight line past the workpiece to be machined, obliquely or transversely to the feed direction of the workpiece.

The invention also relates to a machining unit and machining elements for a device for machining a strip or plate-shaped metal workpiece.

A device of the generic type is disclosed in DE 103 20 295 A1.

In the laser cutting of metal workpieces an oxide layer or oxide skin forms on the cut edges and on the cut faces. One disadvantage of the oxide layer is that any paint or galvanized coating applied over it flakes off again relatively quickly. For this reason the metal workpieces are abraded before painting and galvanizing.

It is furthermore generally necessary for the edges, especially the cut edges, to be deburred and/or radiused. In addition, it may be advantageous to finely abrade the surfaces of the strip or plate-shaped metal workpiece.

An especially advantageous method of removing the oxide layer and deburring the (cut) edges and the cut faces is disclosed by DE 103 20 295 A1. This method provides for a revolving conveyor fitted with at least one machining element, the conveyor conveying the one or more machining elements at least approximately in a straight line past the workpiece to be machined.

Since the machining element, arranged on a revolving conveyor, does not remain rigidly in one position but is conveyed past over the entire length available for throughput of the workpiece, a uniform wear of the one or more machining elements is ensured. The workpiece can at the same time easily be fed or drawn through, preferably transversely to the revolving direction of the machining element, so that the workpiece is uniformly machined by the machining element.

The linear course of the machining element in the area of the workpiece to be machined ensures that the machining element penetrates into all recesses or holes in the workpiece and consequently removes the oxide layer from all cut faces and cut edges. The machining element, drawn along on the workpiece obliquely or transversely to the feed direction of the workpiece, penetrates like a brush being drawn along a piece of metal into every recess.

The device of generic type is advantageously used both to machine the surfaces, that is to say the main faces of the strip or plate-shaped metal workpiece, and to descale the cut faces and cut edges. The device also deburrs the edges and cut faces and can be used for fine abrasion.

Further reference will be made to DE 197 39 895 C2 with regard to the state of the art.

The object of the present invention is to further develop the device of generic type, especially in order to achieve a particularly cost-efficient and uniform machining of strip or plate-shaped metal workpieces, it being further intended that the device should be easy to assemble and service.

A further object of the present invention is to create a machining element and/or a machining unit for a device for machining a strip or plate-shaped metal workpiece, it being further intended that the machining element and/or the machining unit should permit uniform and rapid machining of the strip or plate-shaped metal workpieces and be easy to change.

According to the invention this object is achieved by claim 1 and claim 24 in respect of the device to be created.

According to the invention this object is achieved by claim 19 in respect of an advantageous machining unit and by claim 29 in respect of an advantageous machining element.

A preferred V-belt having a plurality of machining units according to claim 19 and a revolving series of machining elements according to claim 29 are set forth in claims 21 and 30.

Embodying the machining elements according to claim 1 as abrasive papers and arranging support elements between the abrasive papers affords one possible advantageous application of the device according to the invention. The abrasive papers serve on the one hand to remove the oxide layer from the cut faces and cut edges and on the other to deburr and radius the edges. Fine abrasion of the strip or plate-shaped metal workpiece is also possible by means of the abrasive papers. The abrasive papers can be used in various grain sizes, for example a gain size of 60 or 120. The machining elements can be cost effectively embodied as abrasive papers. Not only do the support elements give the abrasive papers a desired stability, they also prevent the abrasive papers rubbing against one another, that is to say they prevent each rear abrasive paper in the revolving direction rubbing against the back of the abrasive paper in front. The support elements can be formed from various materials, a fleece material having proved particularly suitable. Forming them from a felt material has also proved suitable.

In an especially preferred embodiment a support fleece is arranged between each two abrasive papers and a support felt behind the last abrasive paper in the revolving direction (the conveying direction).

As the inventor has discovered, the arrangement of a support felt behind the last abrasive paper in the revolving direction is especially suitable, since felt is both more durable than fleece and can absorb a greater flexural load.

It is particularly advantageous if the support fleece has abrasive, especially finely abrasive characteristics and therefore in addition to the support function also contributes to the machining of the workpiece.

According to the invention the abrasive papers and the support elements may be of approximately the same height and the same width.

Multiple abrasive papers are advantageously combined in a machining unit. In this case a support fleece can in each case be arranged between the abrasive papers and a support felt arranged behind the last abrasive paper in the revolving direction (in the revolving direction of the conveyor). The abrasive papers, the support fleeces and the support felt can preferably be molded into a carrier element of the machining unit. To do this the abrasive papers, the support fleeces and the support felt are inserted into the carrier element or a mold and then cast together. The machining unit formed in this way can easily be screwed to a belt of the conveyor, for example by means of a bolted connection.

It is advantageous here if the underside of the machining unit or the underside of the carrier element of the machining unit has a threaded opening or is provided with a threaded bushing. It may also be advantageous if the belt of the conveyor has correspondingly adapted through-holes, serving both to fix the position of the machining units and to facilitate bolting.

A stable and in particular a torsionally secure fixing of the machining units on the belt can be assisted by fitting a guide track to the belt. At the same time the machining unit, on its underside facing the V-belt, may have a groove to receive the guide track. Any twisting of the machining unit on the V-belt is therefore simply prevented, resulting in a uniform and optimized machining process. The flanks of the groove can, if necessary, be slightly angled (by 2° to 8°, preferably 5°, for example), so that the groove tapers slightly towards the bottom of the groove.

The abrasive papers may preferably have a width of 50 mm. In trials, these values have proved particularly suitable in being able to machine strip or plate-shaped metal workpieces efficiently. It is advantageous here if the abrasive paper has longitudinal slits, which start from the end facing the workpiece to be machined and extend at least over a part of the height of the abrasive papers towards the carrier element. Alternatively, the abrasive papers may each also be formed as individual abrasive leaves. A preferred, especially reliable and cost-effective embodiment is obtained, however, by using abrasive papers with multiple longitudinal slits.

A preferred machining unit for a device for machining a strip or plate-shaped metal workpiece is set forth in claim 19.

A preferred V-belt is set forth in claim 21. The V-belt may be designed to revolve with machining units arranged in series, the machining units preferably being screwed to the V-belt. The machining units are here preferably constructed from a plurality of abrasive papers, a support fleece being formed between each two abrasive papers and a support felt being arranged behind the last abrasive paper in the revolving direction.

According to the invention the stated object is also achieved by a device for machining a strip or plate-shaped metal workpiece as claimed in claim 24.

Embodying the machining elements as bristles means that the oxide layer can be removed from the cut edges and the cut faces in an especially advantageous way. In addition the edges can advantageously be deburred. Providing the machining elements with a groove at one end and a tongue at the other end allows them to be arranged in series, secured against torsion, on the belt. The embodiment with tongue and groove at the same time permits reliable and defined assembly. The embodiment of the machining elements with lateral projections, viewed in the revolving direction of the belt, which serve to support the machining elements over a larger area of the belt, is especially advantageous. In the state of the art, lateral limit stops, intended for torsionally secure fixing of the machining elements, had to be vulcanized onto the belt. The embodiment of the machining elements with lateral projections, together with the tongue and groove, obviates the need for these.

In trials it has proved especially suitable if the belt is embodied as a triple V-belt. The projections on the machining elements then allow support on all three belts. The forces occurring are therefore uniformly distributed and the loads accordingly minimized.

It is especially advantageous if the machining elements are screwed to the belt. This affords an easy, reliable assembly. In addition, the machining elements can easily be changed once the bristles are correspondingly worn. It is advantageous here if the V-belt has a hole and the machining elements have an opening on their underside.

An embodiment in which the machining elements are made from plastics, into which the bristles are injected, has proved especially suitable.

An advantageous machining element having a plurality of bristles for a device for machining a strip or plate-shaped metal workpiece is set forth in claim 29.

Claim 30 sets forth a V-belt having a revolving series of machining elements as claimed in claim 29. According to the invention at least one machining element may have an extended tongue or lug and therefore serve as a compensating block to compensate for belt tolerances. In trials, an extension of the tongue or the lug-shaped projection, which penetrates 1 to 5 mm into the groove in an adjacent machining element, has proved sufficient. The tongue of the machining element serving as compensating block can in this case be correspondingly shortened.

According to the invention the V-belt may be provided with a revolving series of machining elements arranged flush in series with one another, so that the belt is provided with a uniform surface of bristles.

Advantageous embodiments of the invention are set forth in the dependent claims. An exemplary embodiment of the invention is described in principle below with reference to the drawing, in which:

Figure 1:
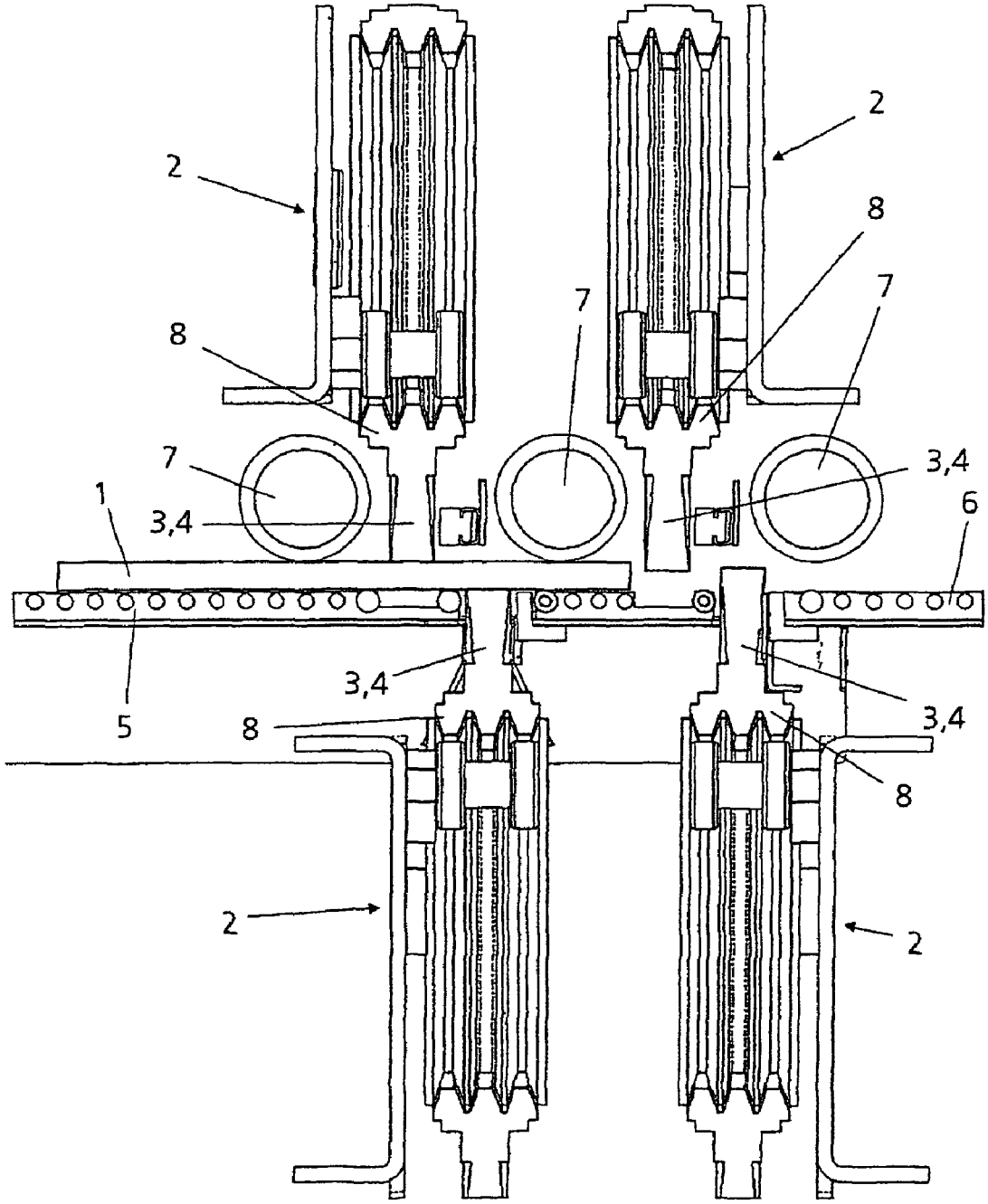
FIG. 1 shows a side view of the device according to the invention having four revolving conveyors.

FIG. 1 shows a device for machining a strip or plate-shaped metal workpiece 1. The device according to the invention is especially suited to removing the oxide layer from cut faces and/or cut edges of the workpiece 1 and for deburring the edges. At the same time it is possible to descale and deburr not only cut faces and cut edges of the workpiece 12 but also cut faces and cut edges of recesses, holes and the like in the workpiece 1.

FIG. 1 shows an especially preferred embodiment of the device according to the invention having four conveyors 2. In principle it is also possible to use a device which has only one conveyor 2. The conveyors 2 are provided with the machining elements 3 and/or machining units 4 described in detail below with reference to FIGS. 2 to 9. The conveyors 2 convey the machining elements 3 or the machining units 4 at least approximately in a straight line past the workpiece 1 to be machined. In the process the workpiece 1 to be machined is conveyed or drawn between the conveyors 2 transversely to the revolving direction of the conveyors 2. A sheet metal insert 5 may be provided on which to place the workpiece 1. A finish table 6 is provided for output of the workpiece 1. In the exemplary embodiment according to FIG. 1, feed rollers 7 are provided, which ensure a uniform and reliable conveying of the workpiece 1 transversely to the revolving directions of the conveyor 2.

The solution according to the invention with four conveyors 2 represented in FIG. 1 allows the workpiece 1 to be fully machined in one pass. It is not necessary to reintroduce the workpiece 1.

An adjusting device serving to vary the engagement depth of the machining elements 3 or the machining units 4 may be provided in a manner not further represented. This is particularly advantageous for correcting the wear of the machining elements 3 and, if necessary, increasing the pressure.

The conveyors 2 are slightly staggered in the direction of passage of the workpiece 1. This ensures firstly that the respective machining elements 3 or machining units 4 of the conveyor 2 do not impede one another and secondly that a uniform, balanced pressure of the machining elements 3 or machining units 4 is nevertheless maintained, which balances itself out, so that the workpiece 1 does not have a tendency to tip over.

The device according to the invention represented in FIG. 1 is a variant, in which the conveyors 2 are arranged flat, so that the machining elements 3 or the machining units 4 run basically horizontally in the area of the workpiece 1.

Alternatively, the solution according to the invention may be provided with upright conveyors 2 in a manner not shown.

In the embodiment of the device according to the invention having four conveyors 2, represented in FIG. 1, it is advantageous if each of the two main faces of the workpiece 1 is in each case machined by two contra-revolving conveyors 2.

The machining elements 3 or the machining units 4 are arranged on a belt 8, which is part of the respective conveyor 2 and revolves in the way described transversely to the feed direction of the workpiece 1.

Reference will be made to DE 103 20 295 A1 with regard to further advantageous embodiments and the technical operating principle of the solution according to the invention represented in FIG. 1.

Figure 2:
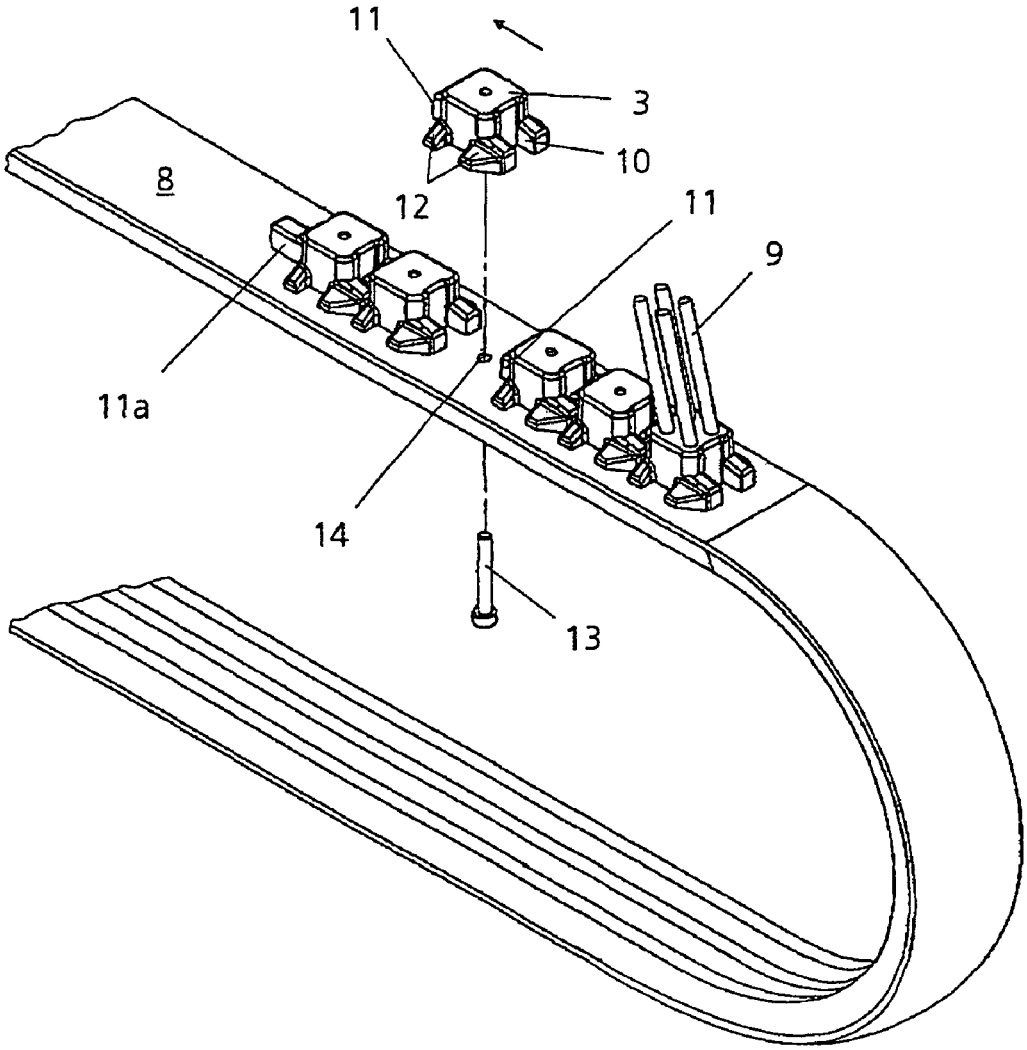
FIG. 2 shows a belt of the device according to the invention, on which machining elements provided with bristles are arranged.

FIG. 2 shows such a belt 8 in an embodiment as V-belt 8. The V-belt is here embodied as a triple V-belt 8. A plurality of machining elements 3 is arranged in series on the V-belt 8, only some of the machining elements 3 being represented, for reasons of clarity. In principle the machining elements 3 run in series all the way around the belt 8, that is to say they form a continuous chain. The machining elements 3 are provided with bristles 9. The bristles 9 are here formed in a known way from metal. In a simple representation the bristles 9 may be formed running straight. It is advantageous, however, to form the bristles 9 with a corrugated or twisted profile, so that the bristles 9 resemble a shaggy brush or a tuft.

The bristles 9 may be injected in bundles into the machining elements 3. The machining elements 3 may here be formed from plastics, for example, and have corresponding receiving holes.

For advantageous fixing of the bristles 9, the bristles 9 may be provided with barbs, not shown in further detail.

The bristles 9 may be inclined by up to 45°, preferably by 15°, in the revolving direction of the V-belt 8. That is to say the tips of the bristles 9, viewed in the revolving direction, are situated in front of the correspondingly remote end of the bristles 9, which is connected to the machining element 3. It has emerged in trials that the bristles 9, obliquely inclined by 15°, are especially advantageous in penetrating into recesses in the workpiece 1, resulting in an especially advantageous removal of the oxide layer from cut faces and cut edges of the workpiece 1 and permitting a radiusing of the edges.

In a manner not shown, the machining elements 3 may also have support bristles, which stabilize the inclined bristles 9 and are therefore intended to improve their capacity to penetrate into recesses in the workpiece 1. The support bristles may be shorter and may have a correspondingly high bending force. An arrangement of the support bristles perpendicular or at right angles to the surface of the machining elements 3 has proved advantageous.

The bristles 9 may advantageously be embodied as corded bristles.

In an alternative embodiment, likewise, not shown, the bristles 9 may also be stabilized or supported by encasement in a sheath covering. The sheath covering may here serve as an alternative to the support bristles. The sheath covering can preferably extend from the bottom end of the bristles 9 to approximately the middle of the bristles 9.

Figure 3:
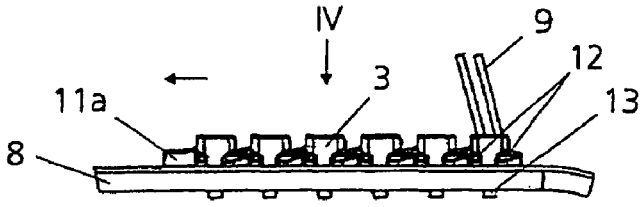
FIG. 3 shows a side view of multiple machining elements, which are screwed to the belt according to FIG. 2, only the rear machining element in the moving direction being provided with bristles, for reasons of clarity.
Figure 4:
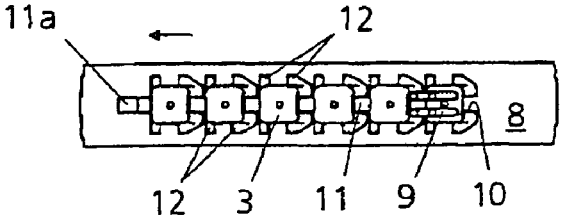
FIG. 4 shows a representation of multiple machining elements viewed in the direction of the arrow IV in FIG. 3.

For reasons of clarity, only one machining element 3 with bristles 9 is represented in FIGS. 2, 3 and 4. Basically each machining element 3 carries bristles 9.

The machining elements 3 have a groove 10 at one end and a tongue 11 at the other end, which serve to join the machining elements 3 together. A twisting of the machining elements 3 is easily and advantageously prevented by the tongue-and groove connection.

Viewed in the revolving direction, the machining elements 3 have lateral projections 12. The projections 12 afford the machining elements 3 support over a larger area of the V-belt 8. Embodying the V-belt 8 as a triple V-belt means that the machining elements 3 are supported on all three belts. In the exemplary embodiment the machining elements 3 have two projections 12 on each side. The projections 12 are preferably integrally formed with the machining element 3. In the exemplary embodiment the machining elements 3 are screwed to the V-belt by a fixing bolt 13. Holes 14 are or can be introduced into the V-belt 8 for this purpose. On their underside facing the V-belt 8 the machining elements 3 have an opening, not shown further, which serves for screw fastening by means of the fixing bolts 13.

In the exemplary embodiment, as can be seen from FIGS. 2, 3 and 4, a machining element 3 has an extended tongue 11*a*. The tongue 11*a* or the lug of this machining element 3 serves to compensate for any belt tolerances and may be correspondingly shortened or tapered. In trials it has emerged that an extension of the tongue 11*a* by 1 to 3 mm is sufficient to serve for tolerance compensation. It has further emerged from trials that it is sufficient to have one machining element 3 with an extended tongue 11*a* per V-belt 8.

A rotational speed of the machining elements 3 with the bristles 9 preferably of 14 to 16 m/s is particularly advantageous. This speed firstly ensures a rapid machining of the workpieces 1 and secondly has proved suitable with regard to the reliability of the machining and the stress loading of the components involved.

Since the bristles 9 are subject to corresponding wear in the operation of the device according to the invention, and consequently have to be replaced, the machining elements 3 can either be detached from the V-belt 8 and new machining elements 3 bolted on, or an entirely new V-belt 8 with machining elements 3 can be fitted.

As an alternative to the V-belt 8 a toothed belt, a flat belt (studded, for example), a chain, a band or the like may be provided. The V-belt 8 represented in FIGS. 2 to 5 may be formed from rubber, plastics, synthetic rubber or preferably from neoprene.

A commercially available V-belt or a power belt is preferably used as V-belt 8.

Figure 5:
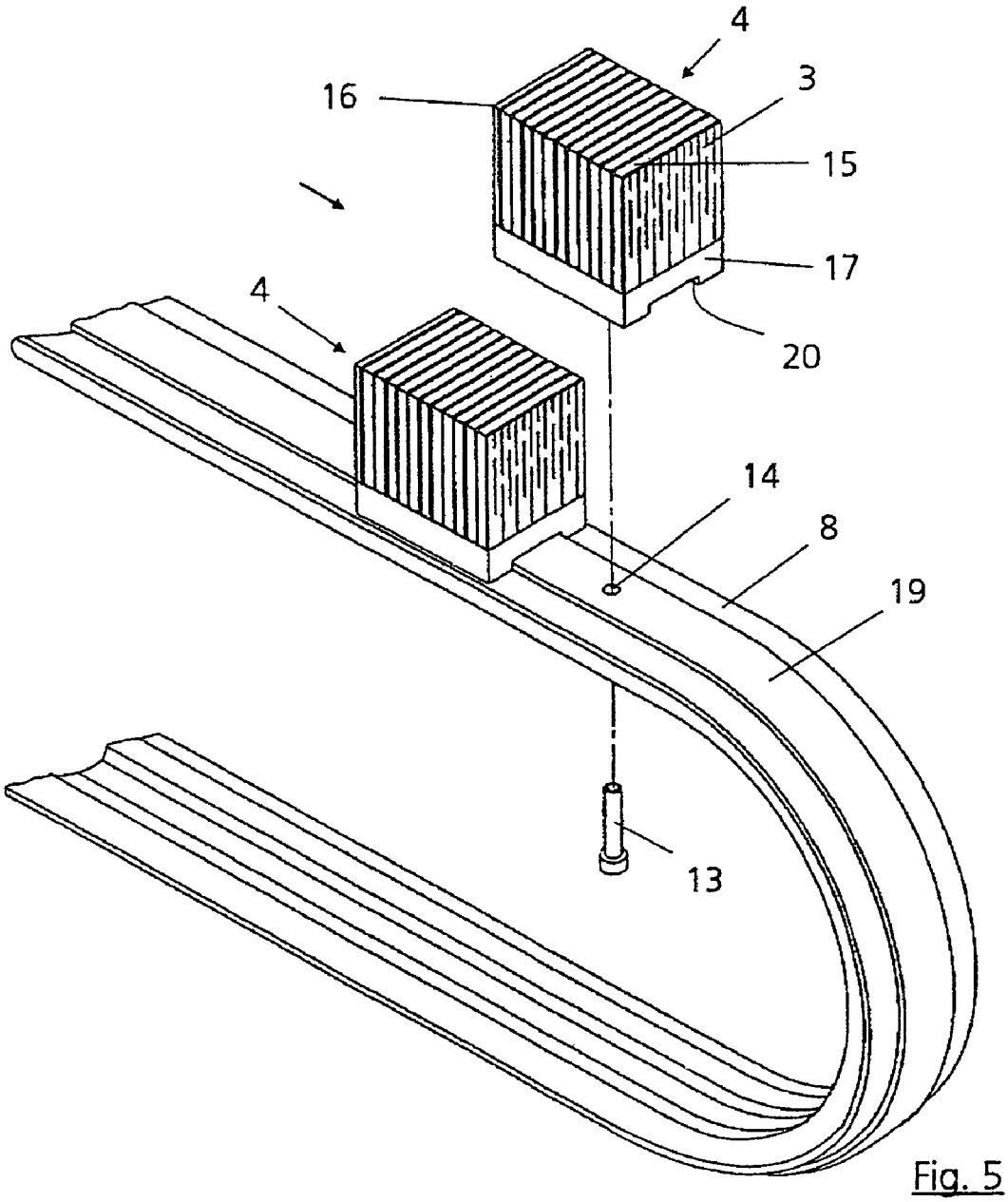
FIG. 5 shows a belt of the device according to the invention, on which a schematically represented machining unit is arranged, which has a plurality of machining elements, which are embodied as abrasive papers and between which support elements are arranged.
Figure 6:
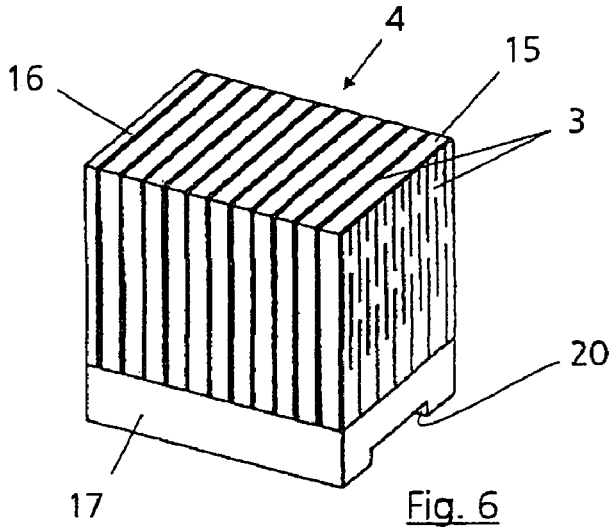
FIG. 6 shows a perspective view of a machining unit, which comprises multiple abrasive papers, between each two of which a support fleece is arranged and behind the last abrasive paper of which, in the revolving direction, a support felt is arranged.
Figure 7:
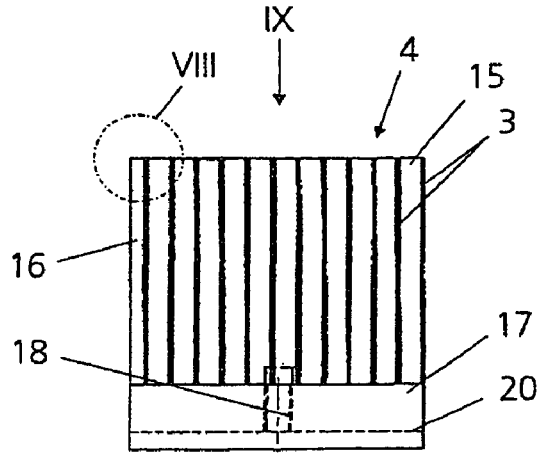
FIG. 7 shows a side view of the machining unit according to FIG. 6.
Figure 8:
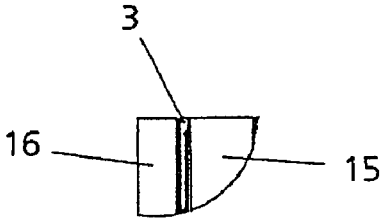
FIG. 8 shows an enlarged detailed representation according to VIII in FIG. 7.
Figure 9:
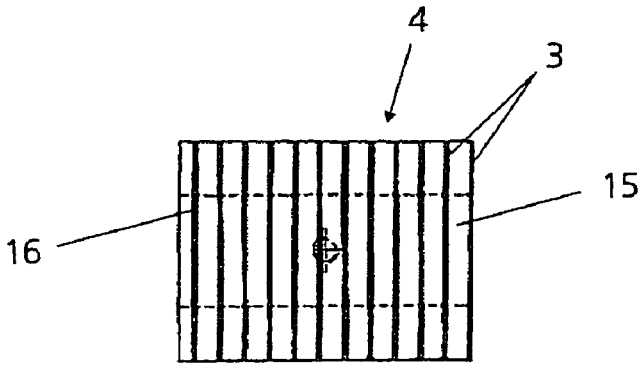
FIG. 9 shows a plan view of a machining unit viewed in the direction of the arrow IX in FIG. 7.

FIG. 5 shows an alternative embodiment of the V-belt 8 and the machining elements 3 to FIGS. 2 to 4. The device according to the invention represented schematically in FIG. 1 can readily be operated both in the embodiment according to FIG. 2 and in the embodiment according to FIG. 5.

As can be seen from FIG. 5, the machining elements 3 in this embodiment take the form of abrasive papers, support elements 15 being arranged between the abrasive papers 3. In the exemplary embodiment the support elements 15 arranged between the abrasive papers 3 are embodied as support fleeces 15 or as abrasive fleeces.

According to FIG. 5 multiple abrasive papers are combined in one machining unit 4. Such a machining unit 4 is shown in detail in FIGS. 6 to 9. The machining unit 4 is constructed in such a way that a support fleece 15 is arranged between each two abrasive papers 3 and a support felt 16 behind the last abrasive paper 3 in the revolving direction. The abrasive papers 3, the support fleece 15 and the support felt 16 are molded into a carrier element 17 of the machining unit 4. For this purpose the carrier element 17 is preferably made from cast resin. An embodiment made from plastics is also possible, however. As an alternative to molding in, the abrasive papers 3, the support fleece 15 and the support felt 16 may also be bonded or clipped.

The machining unit 4 may be screwed, bonded, molded, stamped or welded to the V-belt 8. In the exemplary embodiment the machining unit 4 is screwed to the V-belt 8. For this purpose a hole 14, through which a fixing bolt 13 can be inserted, is or can be made in the V-belt 8. The carrier element 17 of the machining unit 4 has a corresponding threaded bushing 18 or an internal thread on its underside. In order to produce a torsionally secure connection between the V-belt 8 and the machining unit 4, a guide track 19 is furthermore bonded onto the V-belt 8. The guide track may also be welded or vulcanized on. The carrier element 17 of the machining unit 4 here has a groove 20 on its underside facing the V-belt 8 to receive the guide track 19.

The V-belt 8 represented in FIG. 5 may otherwise be embodied in the same way as the V-belt 8 in FIG. 2.

As can be seen from FIGS. 5 to 9, the abrasive papers 3, the support fleeces 15 and the support felt 16 are of approximately the same height and the same width. Here the abrasive paper 3 preferably has a width of 25 to 75 mm and height of 30 to 90 mm. In the exemplary embodiment the abrasive papers 3 preferably have a width of 50 mm and a height of 60 mm. The machining units 4 are formed from a plurality of abrasive papers 3, each machining unit, for example, possibly comprising five to twenty abrasive papers 3. In the exemplary embodiment each machining unit 4 comprises twelve abrasive papers.

The length of a machining unit 4 may be 30 to 90 mm, for example. In the exemplary embodiment a length of 66 mm is provided.

The support fleece 15 may have a thickness of 2 to 10 mm, preferably 5 mm, for example. The thickness of the support felt 16 may be 1 to 8 mm, preferably 3 mm, for example.

In a manner not further represented, the abrasive papers 3, starting from their end facing the workpiece 1 to be machined, may have longitudinal slits, which extend towards the carrier element 17 over at least a part of the height of the of the abrasive papers 3.

The abrasive papers 3, the support fleeces 15 and the support felt 16 are formed tightly adjoining one another.

A rotational speed of the machining units 4 with the abrasive papers 3 of 7 to 8 m/s is particularly advantageous for the machining result.

Combining multiple abrasive papers 3 into one machining unit 4 has proved particularly suitable. In principle, however, the abrasive papers 3 can also each be fitted or joined to the V-belt 8 as separate machining elements. It is important here that support elements are in each case arranged between the abrasive papers 3. Among other things, combining multiple abrasive papers 3 into one machining unit 4 allows the machining elements 3 to be rapidly changed and easily fixed. This is of particular importance owing to the wear that occurs. When the machining elements 3 are worn, the V-belt 8 can either be provided with new machining elements 3 or the entire device can be fitted with a new V-belt 8, to which the machining elements 3 or the machining units 4 have already been fitted.

The invention claimed is:

1. A device for machining a strip or plate-shaped metal workpiece, the device comprising:

at least one revolving conveyor;

a belt as part of the conveyor;

a plurality of machining elements, which are arranged in series on the belt, the machining elements being provided with bristles and having a groove at one end and a tongue at the other end, by means of which the machining elements can be joined together, and the machining elements having lateral projections contacting the belt viewed in the revolving direction;

the conveyor conveying the machining elements at least approximately in a straight line past the workpiece to be machined, obliquely or transversely to the feed direction of the workpiece; and wherein the tongue is capable of lengthwise adjustment relative the other end of the machining element.

2. The device as claimed in claim 1, characterized in that the belt is embodied as a V-belt.

3. The device as claimed in claim 1, characterized in that the belt is embodied as a triple V-belt.

4. The device as claimed in claim 1, 2 or 3, characterized in that the machining elements are screwed to the belt.

5. The device as claimed in claim 1, characterized in that the machining elements have two projections on each side.

6. A machining element having a plurality of bristles for a device for machining a strip or plate-shaped metal workpiece, comprising:

at least one revolving conveyor having a belt;

the belt being capable of being fitted with machining elements the machining elements each having a groove at one end and a tongue at the other end, by means of which the machining elements can be joined and rotationally locked to one another, at least one tongue having a length dimension relative the other end of the machining element and comprising a capability for the length dimension to be adjusted; and as being viewed in the revolving direction of the belt, lateral projections for support on the belt.

7. A V-Belt having a revolving series of machining elements as claimed in claim 6.

8. A device for machining a metal workpiece, the device comprising:

at least one conveyor comprising a belt and configured to rotate the belt in a direction;

a plurality of machining elements provided on the belt, each machining element comprising a lateral projection wherein the lateral projection and the machining element comprise a single integrated structure;

a plurality of bristles extending from each machining element, each of the bristles extending at an angle relative the belt along the direction of the rotation, the angle comprising a degree from about 0° to about 45°; and wherein each machining element has a groove at one end and a tongue at the other end, by means of which the machining elements can be joined and rotationally locked to one another, and wherein the tongues have length dimensions relative the other ends of the machining elements and comprise a capability for the length dimensions to be adjusted.

9. The device of claim 8 wherein the angle comprises about 15°.

10. The device of claim 8 wherein the belt is configured to convey the machining elements at least approximately in a straight line past the workpiece to be machined, obliquely or transversely to the feed direction of the workpiece.

11. The device of claim 8 wherein the plurality of bristles comprises barbs.

12. The device of claim 8 wherein the belt comprises a V-belt.

13. The device of claim 8 wherein the belt comprises a triple V-belt.

14. The device of claim 8 wherein the machining elements are screwed to the belt.

15. A machining element on a rotating belt for machining a metal workpiece, the machining element comprising:

a groove at one end and a tongue at the other end, each groove is capable of receiving a tongue from an adjacent machining element on the belt to join the adjacent machining element in a rotationally locked configuration, the tongue is capable of lengthwise adjustment relative the other end;

lateral projections for support on the belt; and a plurality of bristles extending at an angle relative the belt along the direction of the rotation of the belt, the angle comprising a degree from about 0° to about 45°.

16. The machining element of claim 15 wherein the plurality of the bristles comprises at least one of the following profiles: a corrugated profile and a twisted profile.

17. The machining element of claim 15 wherein the angle comprises about 15°.

18. The machining element of claim 15 wherein the belt comprises a V-belt.

19. The machining element of claim 15 wherein the tongue can be selectively extended or withdrawn from the machining element along the belt.

20. The machining element of claim 15 further comprising a bolt for securement to the belt.

21. A machining element having a plurality of bristles for a device for machining a strip or plate-shaped metal workpiece, the machining element comprising:

at least one rotating conveyor having a triple V-belt;

the belt capable of being fitted with a plurality of machining elements, the machining elements each having a groove at one end and a tongue at the other end to be received in a groove of an adjacent machining element wherein the adjacent machining elements are joined rotationally locked to one another;

lateral projections for support on the belt, wherein the lateral projections allow for the machining element to be supported upon all three of the V-belts; and an opening to receive bolts for securement to the belt.

22. The machining element of claim 21 wherein the plurality of the bristles extend at an angle relative the belt along the direction of the rotation of the belt, the angle comprising a degree from about 0° to about 45°.

23. The machining element of claim 21 wherein the angle comprises about 15°.

24. The device of claim 1 wherein the lateral projection and the machining element comprise a single integrated structure.

25. The device of claim 1 wherein the lateral projection and the machining element comprise a single integrated structure entirely above an uppermost surface of the belt.

26. The machining element of claim 6 wherein the adjustment capability of the tongue comprises a range of length dimensions of about 1 mm to about 3 mm.

27. The machining element of claim 6 wherein the lateral projection and the machining element comprise a single integrated structure positioned entirely, elevationally above an uppermost surface of the belt.

28. The device of claim 8 wherein the single integrated structure of the machining element and the lateral projection is positioned entirely, elevationally above an uppermost surface of the belt.

29. The machining element of claim 15 wherein the lengthwise adjustment capability of the tongue comprises a range of length dimensions of about 1 mm to about 3 mm.

30. The machining element of claim 15 wherein the lateral projections and the machining element comprise a single integrated structure positioned entirely, elevationally above an uppermost surface of the belt.

31. The machining element of claim 21 wherein the lateral projections and the machining element comprise a single integrated structure positioned entirely, elevationally above an uppermost surface of the triple V-belt.

32. The machining element of claim 21 wherein the tongue is capable of lengthwise adjustment relative the other end of the machining element.

33. The machining element of claim 32 wherein the lengthwise adjustment capability of the tongue comprises a range of length dimensions of about 1 mm to about 3 mm.

34. A device for machining a strip or plate-shaped metal workpiece, the device comprising:

at least one revolving conveyor;

a belt as part of the conveyor;

a plurality of machining elements, which are arranged in series on the belt, the machining elements being provided with bristles and having a groove at one end and a tongue at the other end, by means of which the machining elements can be joined together, and the machining elements having lateral projections contacting the belt viewed in the revolving direction;

the conveyor conveying the machining elements at least approximately in a straight line past the workpiece to be machined, obliquely or transversely to the feed direction of the workpiece; and wherein the lateral projection and the machining element comprise a single integrated structure entirely above an uppermost surface of the belt.

35. A device for machining a metal workpiece, the device comprising:

at least one conveyor comprising a belt and configured to rotate the belt in a direction;

a plurality of machining elements provided on the belt, each machining element comprising a lateral projection wherein the lateral projection and the machining element comprise a single integrated structure;

a plurality of bristles extending from each machining element, each of the bristles extending at an angle relative the belt along the direction of the rotation, the angle comprising a degree from about 0° to about 45°; and wherein the single integrated structure of the machining element and the lateral projection is positioned entirely, elevationally above an uppermost surface of the belt.

* * * * *

UNITED STATES PATENT AND TRADEMARK OFFICE

CERTIFICATE OF CORRECTION

PATENT NO. : 7,789,735 B2
APPLICATION NO. : 11/989442
DATED : September 7, 2010
INVENTOR(S) : Josef Weiland It is certified that error appears in the above-identified patent and that said Letters Patent is hereby corrected as shown below:

Column 2, lines 10-11 – Remove "by claim 1 and claim 24"

Column 2, lines 12-13 – Remove "by claim 19"

Column 2, lines 13-14 – Remove "by claim 29"

Column 2, line 16 – Remove "according to claim 19"

Column 2, lines 17-18 – Replace "elements according to claim 29 are set forth in claims 21 and 30." with --elements are set forth.--

Column 2, line 28 – Replace "gain size" with --grain size--

Column 3, line 27 – Remove "in claim 19"

Column 3, line 28 – Remove "in claim 21"

Column 3, line 38 – Remove "as claimed in claim 24"

Column 7, line 58 – Replace "height of the of the abrasive" with --height of the abrasive--

Signed and Sealed this
Eighteenth Day of October, 2011

David J. Kappos

David J. Kappos
*Director of the United States Patent and Trademark Office*

UNITED STATES PATENT AND TRADEMARK OFFICE

CERTIFICATE OF CORRECTION

PATENT NO. : 7,789,735 B2
APPLICATION NO. : 11/989442
DATED : September 7, 2010
INVENTOR(S) : Josef Weiland It is certified that error appears in the above-identified patent and that said Letters Patent is hereby corrected as shown below:

Title page, item (73) Assignee – Replace "Lissmac Maschinenbau und Diamantwerkzeuge GmbH" with --LISSMAC Maschinenbau GmbH--

Signed and Sealed this
Twenty-fourth Day of January, 2012

David J. Kappos

David J. Kappos
*Director of the United States Patent and Trademark Office*